US009453437B2

(12) United States Patent
Patterson et al.

(10) Patent No.: US 9,453,437 B2
(45) Date of Patent: Sep. 27, 2016

(54) COLLAPSIBLE PUSHROD VALVE ACTUATION SYSTEM FOR A RECIPROCATING PISTON MACHINE CYLINDER

(71) Applicants: Donald James Patterson, Ann Arbor, MI (US); Kevin Michael Morrison, Ann Arbor, MI (US); George Byron Schwartz, Canton, MI (US)

(72) Inventors: Donald James Patterson, Ann Arbor, MI (US); Kevin Michael Morrison, Ann Arbor, MI (US); George Byron Schwartz, Canton, MI (US)

(73) Assignee: ELECTRO-MECHANICAL ASSOCIATES, INC., Ann Arbor, MI (US)

( * ) Notice: Subject to any disclaimer, the term of this patent is extended or adjusted under 35 U.S.C. 154(b) by 0 days.

(21) Appl. No.: 14/924,327

(22) Filed: Oct. 27, 2015

(65) Prior Publication Data

US 2016/0123193 A1 May 5, 2016

Related U.S. Application Data

(60) Provisional application No. 62/072,242, filed on Oct. 29, 2014.

(51) Int. Cl.
*F01L 1/34* (2006.01)
*F01L 1/04* (2006.01)

(52) U.S. Cl.
CPC ... *F01L 1/34* (2013.01); *F01L 1/04* (2013.01)

(58) Field of Classification Search
CPC ..... F01L 1/34; F01L 1/04
USPC ..... 123/90.16
See application file for complete search history.

(56) References Cited

U.S. PATENT DOCUMENTS 3,518,976 A * 7/1970 Thuesen ..... F01L 1/146 123/90.16
4,796,573 A * 1/1989 Wakeman ..... F01L 1/16 123/90.16

(Continued)

FOREIGN PATENT DOCUMENTS

DE 2907033 A1 9/1980
RU 2104402 C1 2/1998

(Continued)

OTHER PUBLICATIONS

Michael C. Turkish, "Valve Gear Design", p. 3, Published by Eaton Corporation, 1946.

(Continued)

*Primary Examiner* — Zelalem Eshete
(74) *Attorney, Agent, or Firm* — Jelic Patent Services, LLC; Stanley E. Jelic

(57) ABSTRACT

A valve actuation system is described containing a collapsible pushrod device for use in a reciprocating piston machine cylinder such as an engine. The collapsible pushrod device replaces a conventional pushrod. The system can include a driver base, plunger, and a deactivation pin assembly. In normal operation, the pins lock the driver base and plunger together thereby providing regular valve motion. Under selected conditions, the pin assembly controller unlocks the driver base from the plunger. Valve lift is reduced or eliminated. When eliminated, the cylinder is deactivated. The system can vary the effective compression ratio between higher for cold starting and other selected operating conditions and lower for warmed-up running, as well as trap additional exhaust residuals to assist starting and light load. This is especially useful for Diesel engines. Various means may be used to unlock the pins including oil pressure, bi-metal spring temperature, or electromagnetic activation. The telescoping motion which limits the motion of the valve may occur in one or more steps.

11 Claims, 8 Drawing Sheets

(56) References Cited

U.S. PATENT DOCUMENTS

| | | | | |
|---|---|---|---|---|
| 5,816,204 | A * | 10/1998 | Moriya | F01L 1/34 123/90.17 |
| 6,474,702 | B1 * | 11/2002 | Malone | E05B 47/0009 292/97 |
| 7,395,792 | B2 | 7/2008 | Hendriksma et al. | |
| 2002/0121255 | A1 * | 9/2002 | Speil | F01L 1/146 123/90.52 |
| 2010/0043738 | A1 * | 2/2010 | Grandvallet | F16K 31/0603 123/90.39 |
| 2011/0023801 | A1 * | 2/2011 | Berger | F01L 9/021 123/90.16 |

FOREIGN PATENT DOCUMENTS

| | | |
|---|---|---|
| RU | 2156867 C1 | 9/2000 |
| SU | 1493801 A1 | 7/1989 |

OTHER PUBLICATIONS

C.F. Taylor, "The Internal Combustion Engine in Theory and Practice", p. 522, Published by MIT Press, Second Edition, 1985.

PCT-US2015057886, International Search Report and Written Opinion, all pages (1-5), mailing date is Jan. 28, 2016, search and opinion performed by ROSPATENT.

* cited by examiner

COLLAPSIBLE PUSHROD VALVE ACTUATION SYSTEM FOR A RECIPROCATING PISTON MACHINE CYLINDER

CROSS-REFERENCE TO RELATED APPLICATIONS

This application claims the priority benefit of U.S. Provisional Application 62/072,242 filed Oct. 29, 2014, which is herein incorporated by reference in its entirety.

TECHNICAL FIELD

The present disclosure relates to reciprocating piston machine cylinders. More particularly, the present invention focuses on reciprocating piston machine cylinder valve activation.

BACKGROUND

The statements in this section merely provide background information related to the present disclosure. Accordingly, such statements are not intended to constitute an admission of prior art.

Poppet valves are widely used in Diesel engines, spark-ignited engines, and other reciprocating piston machines. Diesel engines are widely used in heavy duty vehicles, light duty vehicles, electrical generators, and a variety of other applications. Engine design compression ratio is a compromise between power, economy, emissions, and cold startability. In Diesel engines, the optimum compression ratio for best fuel economy is less than 15:1, whereas the necessary compression ratio for cold starting ranges from 16:1 to 23:1 and depends on the specific design of the engine and its application. This compression ratio range is too high for best economy, lowest emissions and optimum power boost.

Typically, engines are sized larger than needed for the majority of their service in order to provide reserve power for excessive loads such as hill climbing or passing in the case of road vehicles or to support an unusually high power requirement in the case of stationary power generators or stationary refrigeration vehicles on an especially hot day. Consequently, much of the time the engine is operated at a fraction of its design power capability in particular applications involving extensive idling and/or light load operation such as military surveillance vehicles, idling long haul trucks and stationary electric generators, etc.

BRIEF SUMMARY OF THE INVENTION

A collapsible pushrod system improves the part load efficiency and provides other benefits for reciprocating piston machines by allowing variable valve timing. A collapsible pushrod actuation system configured to reduce a poppet valve lift of a reciprocating piston machine cylinder can comprise: a lifter configured to be actuated by a cam lobe; and a collapsible pushrod device functionally attached to the lifter and configured to either partially or fully collapse. The collapsible pushrod device replaces a standard pushrod.

In one embodiment, the collapsible pushrod system comprises a driver section, a plunger section, and a deactivation assembly that contains lock pins within a housing. Under normal operating conditions, the pins lock the driver and the plunger sections together to actuate the poppet valve with standard valve lift as provided by the cam lobe. Upon command, for example by oil pressure, the pins are retracted and the plunger telescopes with respect to the driver, thereby reducing or eliminating valve motion.

In a separate embodiment, the collapsible pushrod device further incorporates a temperature sensitive bi-metal spring to actuate the lock pins to lock or unlock the driver and plunger sections based on engine temperature.

In a separate embodiment, the collapsible pushrod device further incorporates an electromagnetic mechanism to lock or unlock the driver and plunger sections.

In a separate embodiment, the system further incorporates a damper that is functionally attached to the rocker arm and configured to slow a rate at which the poppet valve closes.

In a separate embodiment the collapsible pushrod device may consist of multiple collapser units.

In a separate embodiment, a variable oil pressure is used to control the extent to which the collapsible pushrod device with multiple collapser units will collapse.

The scope of the invention is defined by the claims, which are incorporated into this section by reference. A more complete understanding of embodiments on the present disclosure will be afforded to those skilled in the art, as well as the realization of additional advantages thereof, by consideration of the following detailed description of one or more embodiments. Reference will be made to the appended sheets of drawings that will first be described briefly.

BRIEF DESCRIPTION OF THE DRAWINGS

A clear understanding of the key features of the invention summarized above may be had by reference to the appended drawings, which illustrate the method and system of the invention, although it will be understood that such drawings depict preferred embodiments of the invention and, therefore, are not to be considered as limiting its scope with regard to other embodiments which the invention suggests. Accordingly.

DETAILED DESCRIPTION

Figure 1:
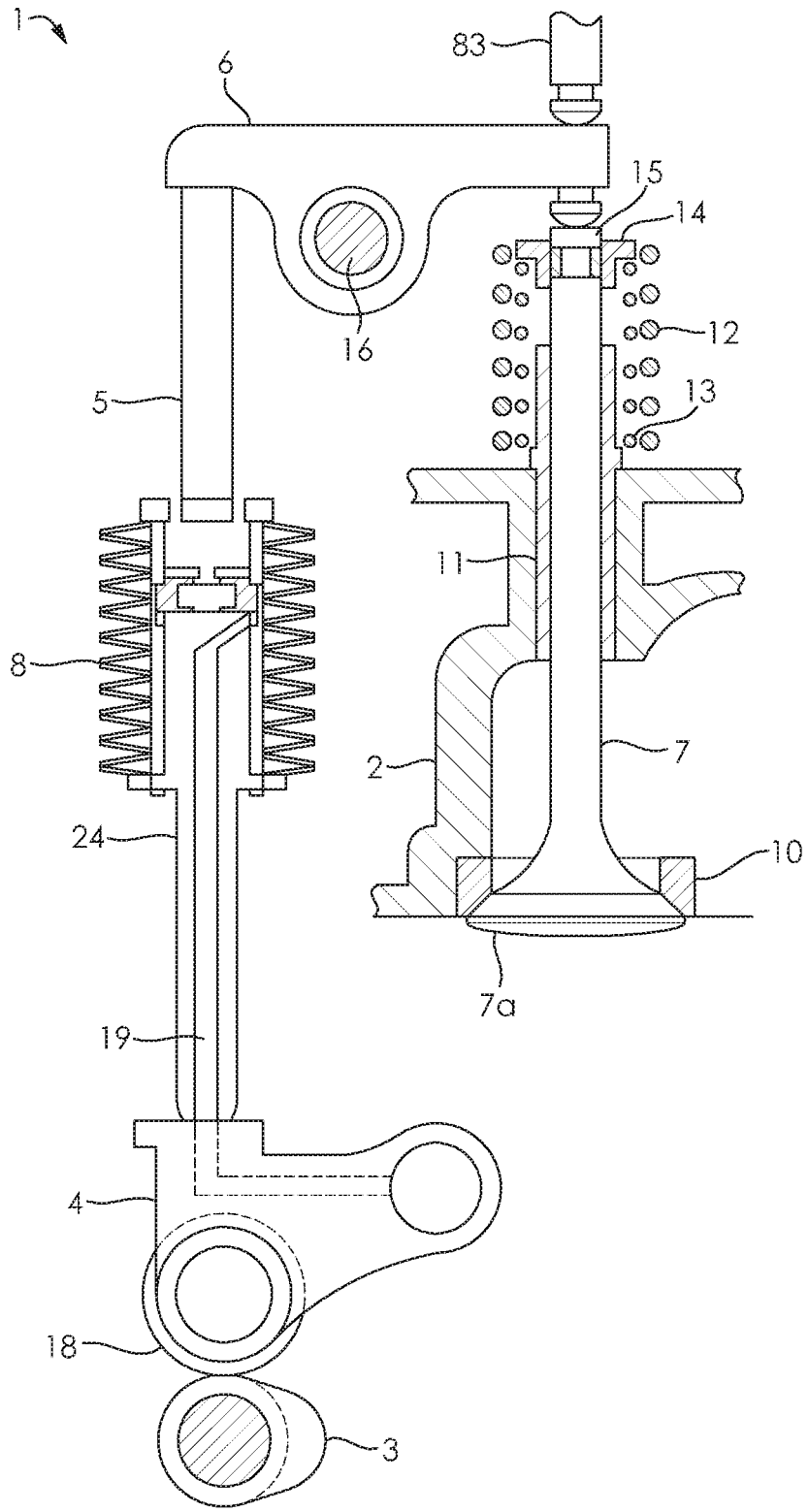
FIG. 1 is an overall view of the valve train of a pushrod style, poppet valve engine with a collapsible pushrod valve actuation system (CPS). It includes optional damping.

The following detailed description of the invention is merely exemplary in nature and is not intended to limit the invention or the application and uses of the invention. Furthermore, there is no intention to be bound by any theory presented in the preceding background of the invention or the following detailed description of the invention.

A collapsible pushrod valve actuation system for a reciprocating piston machine cylinder may be applied to a Diesel engine. Since the design compression ratio of 16:1 up to 23:1 for automotive and heavy duty Diesel engines is for starting conditions, sacrifices are made with regards to warm engine fuel economy, emissions, and optimum power boost. The best economy compression ratio for a warm engine may be as low as 15:1 or even lower. Hence, there exists a need to enable reduced automotive and heavy duty Diesel engine compression ratios, after the engine has been successfully started and warmed-up.

Since the engine power is larger than optimum for best economy under moderate load operation, cylinder cut-out or deactivation is desirable. This not only saves fuel, but lowers emissions as well. Hence, there exists a need to enable cylinder cut-out for some cylinders of a multi-cylinder engine under selected engine light to moderate load conditions.

Devices have been proposed for adjusting the valve timing of piston engines. Some are in production for spark-ignited engines. The inventors have previously patented a two mode valve actuator device applied to the Diesel engine, U.S. Pat. No. 8,316,809 B1. This invention which is incorporated into the lifter is based around a combination of both partly deactivating valve lift and optionally damping the modified lifter motion under selected conditions such as starting. A number of Patents for Spark-Ignited (SI) engines that are based upon two-mode hydraulic valve lifter action have been issued to Delphi and General Motors (GM). These patents form the basis of the design for the GM Displacement On Demand (DOD) production engine system, for example the Delphi Patent by Hendriksma et. al. U.S. Pat. No. 7,395,792 B. The authors are unaware of any patents for multiple-mode valve operation based on a collapsible pushrod system for engines employing either mechanical or hydraulic valve lifters.

The content of U.S. Pat. No. 8,316,809 B1 is herein incorporated by reference in its entirety.

Variable valve lifting means have not been applied to the Diesel, as far as the inventors know, because of interference between the piston crown and valves if the cam timing itself is changed. Also most mechanisms that vary the compression ratio are not useful for Diesel engines because of changes to the combustion chamber shape and thus to the combustion itself. The Diesel engine is not tolerant of changes to the combustion system in an otherwise optimized engine.

It is a common practice to close the intake valve up to or more than 60 crank angle degrees after the piston reaches bottom dead center. This is to enhance high speed engine power. But, this late closing reduces the effective compression ratio by 2 or 3 ratios depending on the intake valve closing angle. For example, a design ratio of 18:1 is needed to provide a suitable effective ratio of 15:1 because of late intake valve closing when the closing angle is 60 crank angle degrees.

To compensate for this reduced compression, the present disclosure describes a pushrod based valve lift mechanism, the CPS, which can operate in either of two modes, normal valve lift, or modified valve lift. This means that the combustion chamber design is optimized for fuel economy and emissions for normal running, but then the compression ratio is effectively raised via the CPS, when required, for example cold starting and warm-up, without affecting the geometry and performance of the combustion chamber or introducing mechanical interference.

One object of the present invention is to provide a means to lower the design compression ratio of the Diesel engine that will not diminish cold startability and optionally provide the ability to control valve train noise and vibration. A second objective is to provide means to disable valve motion in order to deactivate a cylinder of a reciprocating piston machine. Another objective of the present invention is to provide a two mode valve actuation system that provides higher compression for starting an engine, but a lower compression ratio for normal running.

Another objective is to deactivate some cylinders in order to operate an engine at reduced load with better fuel economy and lower emissions.

Another objective is to use the CPS to alternate deactivated cylinders during reduced load conditions to equalize machine wear.

Another object of the present invention is to provide two levels of compression as a means to increase the fuel economy of the Diesel engine without sacrificing cold startability or creating excess noise and vibration.

Another object of the present invention is to allow an engine to operate at a lower compression ratio during warmed-up operation thus reducing engine-out $CO_2$ emission as well as soot and hydrocarbon emissions without sacrificing cold startability.

Another object of the present invention is to improve fuel economy by allowing the use of the Miller Cycle which uses late intake valve closing during warmed-up engine operation without the loss of cold start or warm-up capability created by the reduced compression inherent with the Miller Cycle.

Another object of the present invention is to provide two or more levels of compression as a means to increase the power boost of the Diesel engine when operating at a lower design compression ratio without sacrificing cold startability.

Another object of the present invention is to provide two or more modes, pushrod valve actuation system that can be incorporated into a reciprocating machine without significant redesign of the structure.

Another object of the present invention is to provide two or more modes, pushrod valve actuation system that can be retrofit into an existing engine design without significant modification of the engine.

Another object of the present invention is to provide a means for switching two or more modes, pushrod valve actuation system from early intake valve closing for cold start and light load running to normal valve closing for other engine speeds and loads.

Another object of the present invention is to provide a means to disable valve motion totally in a reciprocating machine.

Another object of the present invention is to provide two or more modes, pushrod valve actuation system that retains controlled amounts of exhaust gases in the engine cylinder to facilitate cold starting and cold drive-away.

Another object of the present invention is to suggest key parameters for a control strategy for selecting the operating mode of a multiple mode, pushrod valve actuation system with or without optional damping.

Another object of the present invention is to provide a multiple mode, pushrod valve actuation system that is more universally functional in today's market than the prior art systems.

It is intended that any other advantages and objects of the present invention that become apparent or obvious from the detailed description or illustrations contained herein are within the scope of the present invention.

FIG. 1 illustrates a type of conventional valve train modified to include the CPS components 1. As in a conventional valve-train, the cam 3 bears on the roller 18 which in turn rotates the lifter 4 which pivots on axle 9. The movement of the lifter 4 then moves the collapsible pushrod device 8 which bears on rocker 6. In the normal mode when moved, the collapsible pushrod device 8 causes the rocker arm 6 to rotate about pivot 16, thus moving the valve 7. Valve 7 consists of stem connected to valve head 9 and seats on the valve seat insert 10 which is inserted into cylinder head 2. The valve 7 is supported in the valve guide insert 11. The inner spring 13 and outer spring 12 preload the valve, thus keeping it tightly closed unless lifted by the cam 3. The springs are constrained by the spring washer 14 and keeper 15. The CPS includes driver base 24 and plunger 5, and is described in detail in connection with FIG. 2, FIG. 3A and FIG. 3B. The CPS may contain, as needed, an element to provide soft opening of valve 7 under partial lost motion operation. The CPS may require a damper 83 which, if needed, provides a soft landing to valve 7 under partial lost motion operation. In the configuration providing total valve disabling such damping is irrelevant and not needed as no valve movement occurs.

In normal operation, the valve lifter 4 lifts the collapsible pushrod device 8 causing the rocker arm 6 to rotate thus opening valve 7. Applied to an engine for cold starting and perhaps other selected light load, low speed conditions as well as valve disabling; the CPS comes into play. Collapsible pushrod device 8 may be partially or totally telescoped so that it limits the lift of plunger 5. When valve motion occurs, the optional dampers 83 as well as damping within the collapsible pushrod device 8 provide a smooth, quiet beginning and ending to the valve motion.

Lubricant oil passages 17 and 19 provide an oil pressure control signal to change the operating mode by activating the collapsible pushrod device 8. Alternatively, the oil pressure signal can emanate from a drilling in rocker 6 through a passage in plunger 5, a design discussed in connection with FIG. 8. How oil pressure changes the CPS operating mode is discussed in connection with FIG. 2.

Figure 2:
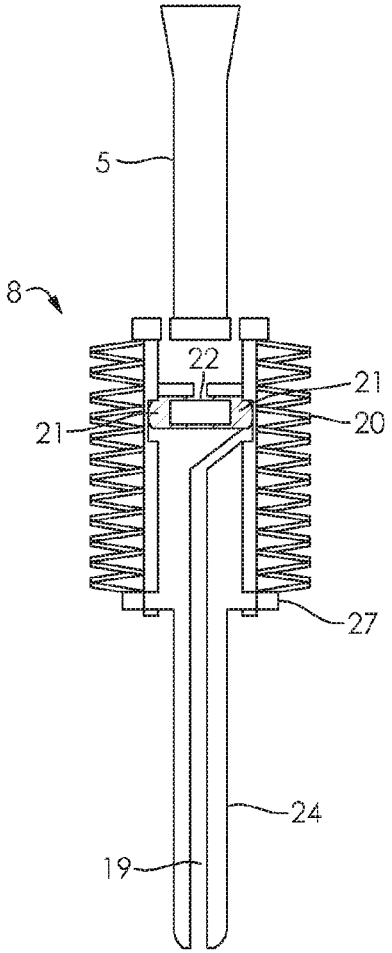
FIG. 2 is one embodiment of the collapsible pushrod device.

FIG. 2 shows details of the collapsible pushrod device 8. The collapsible pushrod device 8 consists of driver body 24 which contains lubricating oil activation passage 19 and plunger 5. The driver body 24 is moved by the motion of lifter 4 which is driven by cam 3. When not activated by oil pressure the pins 21 lock driver body 24 and plunger 5 together. The pins are deployed by the spring 22. When locked the CPS lifts the valve in the normal manner.

When oil pressure is applied through passage 19, the pins 21 are retracted against the force of spring 22 thereby unlocking plunger 5 from driver body 24. Varying the spring rate allows a different pressure to lock and unlock the pins. When the pins are retracted, the movement of the driver body 24 is no longer transmitted directly to the plunger 5, but instead through spring 20 which gradually compresses as the cam attempts to open the valve. When the spring 20 is sufficiently weak, it is compressed as the cam attempts to open the valve, but even at the maximum lift of the cam does not exert enough force to overcome the restraining force provided by springs 12 and 13. The valve 9 does not open. If spring 20 is stronger, it provides enough force part way through the lift of the cam 3 to overcome the restraining force exerted by springs 12 and 13, and partially opens the valve 9. Thus by selecting the strength of spring 20, the CPS can cause the valve 9 to open later and close earlier than that normally provided by the cam 3.

In the present disclosure, one objective is to provide a higher effective compression ratio of an engine for starting and other selected conditions thus allowing a lower engine design compression ratio. The effective and design compression ratios are further explained in a paragraph below describing FIG. 7. Another objective is to provide increased engine exhaust residuals to assist starting. Another objective is to disable valve motion totally in order to deactivate the cylinder. Some criteria and means are required to cause movement of latching pins 21 to cause this to occur at the proper time. In FIG. 2, the pins 21 are activated by a change in oil pressure in actuating passage 19, similar to the GM DOD system. Alternatively, oil pressure can be applied through a drilling in pushrod 5 from a source in rocker 6 as described in connection with FIG. 8. Other means to activate the pins can be used. An example of another means to move pins 21 is a bi-metal spring which could bear on the pins to move them as temperature rises. When the engine and engine oil are cold, the bi-metal spring would cause pins 21 to be withdrawn, thus changing the effective compression ratio by allowing lost motion of the lifter. As the engine and oil warm, the bi-metal spring inserts the pins into lifter body 24 in a rapid, snap action manner. No further movement of pins 21 occur until the engine and oil cool below a prescribed set temperature at which condition the pins 21 retract and lost motion ensues.

Other means are also envisioned in addition to the change in oil pressure design of the GM system. This could be electromagnetic activation, thermal expansion, or other means which could be computer controlled.

A computer program provides optimum control based on temperature, emissions, engine rotational speed and load, noise and engine smoothness; and tailored to each engine and application to provide optimal valve lift and timing.

The above discussion of means to activate the locking pins of the CPS applies to other reciprocating piston machines as well.

Figure 3A:
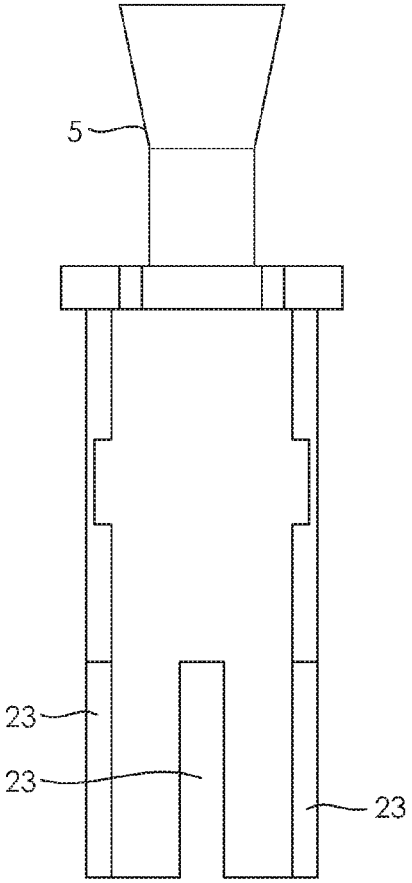
FIG. 3A shows selected details of the collapsible pushrod device.
Figure 3B:
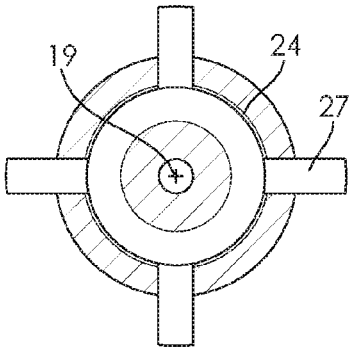
FIG. 3B shows additional details of the collapsible pushrod device.

FIG. 3A and FIG. 3B show additional details of the collapsible pushrod device 8 of FIG. 2. The plunger 5 is shown in FIG. 3A, containing open slots 23. Referring to FIG. 3B, these slots 23 allow the arms 27 of driver body 24 to moveably slide within plunger 5 as the collapsible pushrod device 8 telescopes. This arrangement is an example of one design which makes the collapsible pushrod device rigid, but allows freely collapsing motion between body 24 and plunger 5 when the collapsible pushrod device is activated.

Figure 4:
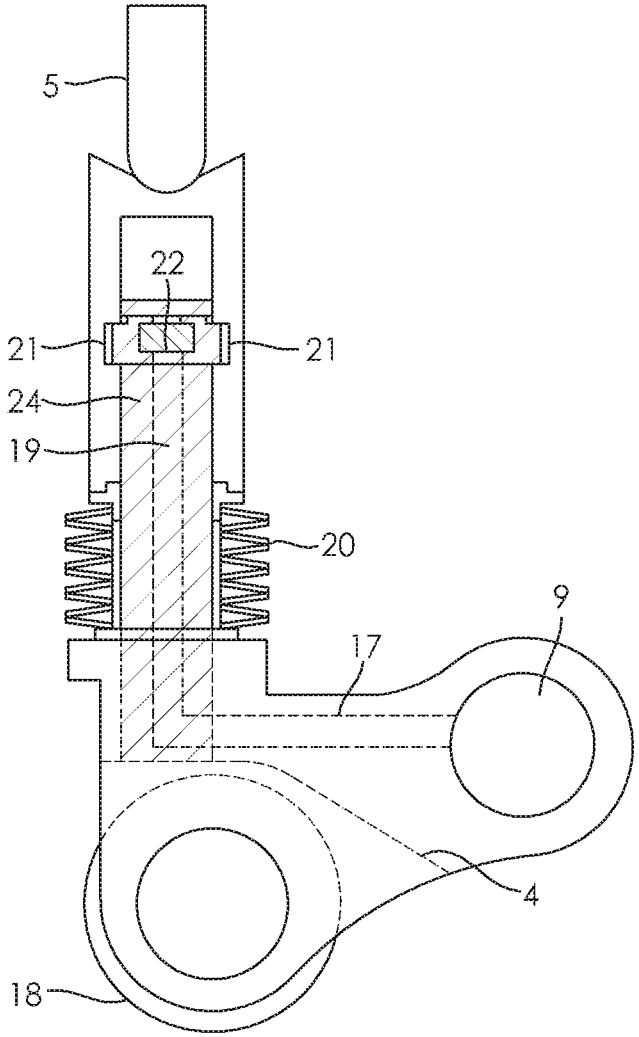
FIG. 4 is a view of an alternate collapsible pushrod valve actuation system embodiment in which the collapsible pushrod device driver base is built into the lifter.

FIG. 4 shows an alternate embodiment in which the CPS driver body 24 is built into the lifter 4. As in the previous embodiment shown in FIG. 1, the cam bears upon roller 18 which moves the lifter 4 which pivots about axle 9. In normal operation when the plunger 5 and driver body 24 are locked together, the entire CPS moves together with lifter 4 to lift the valve. When the oil control signal is sent though passages 17 and 19, it activates the CPS by moving pins 21 which compress spring 22, causing either partial movement or no movement of plunger 5 and thereby producing partial or no movement of valve 9 depending on the strength of spring 20.

Figure 5A:
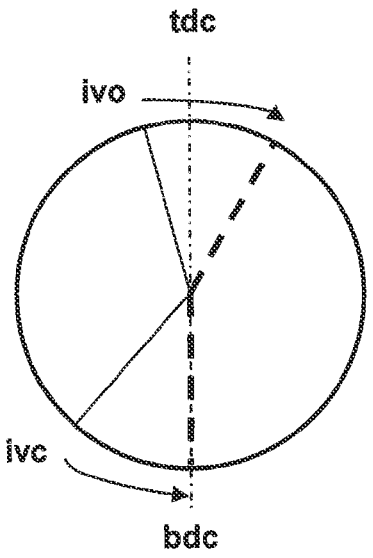
FIG. 5A shows a typical intake valve timing diagram and the changes imparted by the collapsible pushrod valve actuation system of later valve opening and earlier valve closing.

FIG. 5A shows the effect of the present invention on the intake valve timing in the partial lift configuration. The design intake valve opening (ivo) and the design intake valve closing (ivc) angle are indicated by the solid lines. Top dead center (tdc) and bottom dead center (bdc) are indicated. The two mode CPS causes the ivo and ivc to move according to the arrows into the dashed line positions. As shown the modified ivc is near bdc.

Figure 5B:
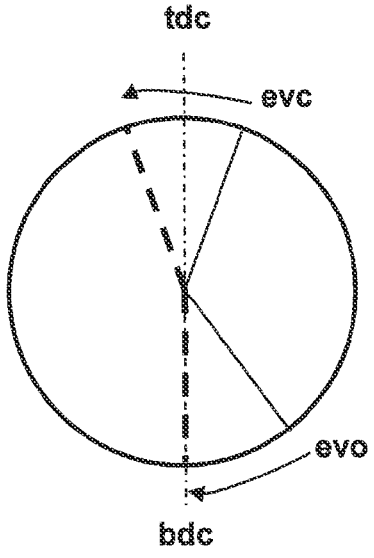
FIG. 5B shows a typical exhaust valve timing diagram and the changes imparted by the collapsible pushrod valve actuation system of later valve opening and earlier valve closing.

FIG. 5B shows the effect of the present invention on the exhaust valve timing in the partial lift configuration. The design exhaust valve opening (evo) and the design exhaust closing angle (evc) are indicated by the solid lines. Top dead center (tdc) and bottom dead center (bdc) are indicated. The two mode CPS causes the evo and evc to move according to the arrows into the dashed line positions. As shown, the modified evc is before bdc in order to retain exhaust residual gases in an engine cylinder which assists cold starting and warm-up.

Figure 6:
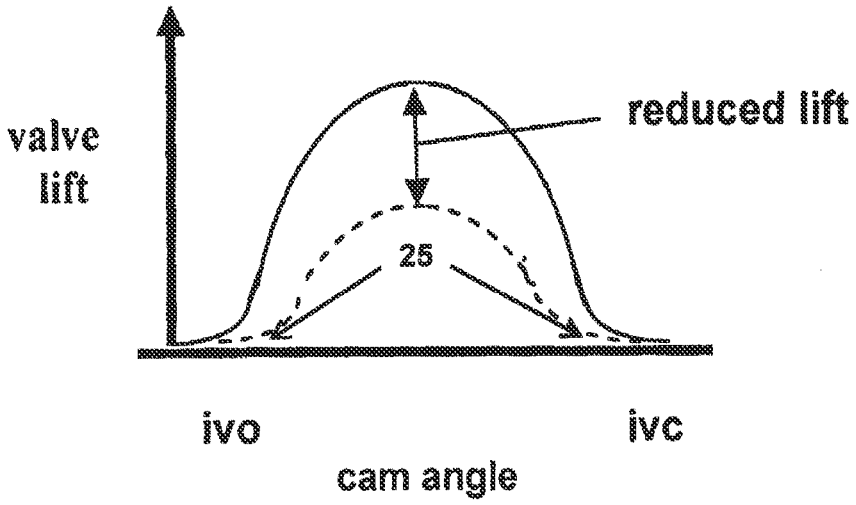
FIG. 6 shows the normal valve lift and the reduced lift imparted by the collapsible pushrod valve actuation system when the optional damping is employed.

FIG. 6 shows the intake or exhaust valve lift provided by the CPS in partial lift configuration compared to normal lift. Normal lift (solid line) starts earlier and ends later than the dead centers, providing the usual valve lift of opening before and closing the valve after the dead center piston positions. The lower dashed curve shows the action of the CPS. When applied to an engine cylinder, lost motion causes later opening and earlier valve closing, thus raising the effective engine compression ratio when applied to the intake valve and trapping additional exhaust residual gases when applied to the exhaust valve. Effective compression ratio is more fully discussed in connection with FIG. 7. The effective compression ratio is raised to the engine design ratio by closing the intake valve 7 near bottom dead center, bdc, although a lesser compression ratio increase is possible based on the strength of the spring 20. In partial lift mode the exhaust valve would open near bottom center and might close about 10 to 20 degrees before top center. The gradual ramps 25 in the partially deactivated mode are provided by the optional damper 83 and within plunger 8. The maximum lift with the CPS activated is lower than the design lift and the difference is indicated by the arrow marked reduced lift. Lower intake valve lift does not reduce the filling of an engine cylinder under low speed conditions when the CPS is employed. On the exhaust valve, lower lift combined with early valve closing work together to trap additional exhaust residual gases.

Figure 7:
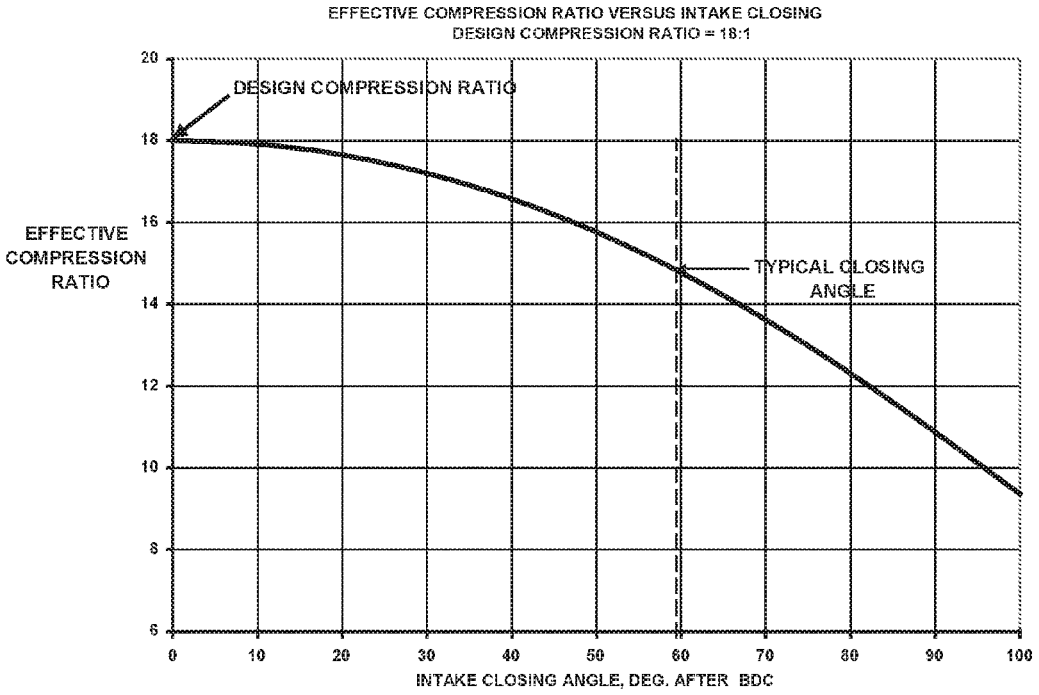
FIG. 7 shows the effective compression ratio for various intake valve closing angles for an engine with a design compression ratio of 18:1.

FIG. 7 shows, as an example, the effective compression ratio with various intake valve closing angles for a Diesel engine with a design compression ratio of 18:1 The design compression ratio is based on intake valve closure when the piston is at bottom dead center (BDC) of its stroke. Many engines have intake valve closing when the piston is 60 crank angle degrees after bottom dead center as the line labeled TYPICAL CLOSING ANGLE indicates. As a result the effective compression ratio is reduced to slightly below 15:1 for a design compression ratio of 18:1. Using the CPS mechanism, the design compression ratio could be reduced, possibly as low as 15:1 without loss of cold start capability.

Figure 8:
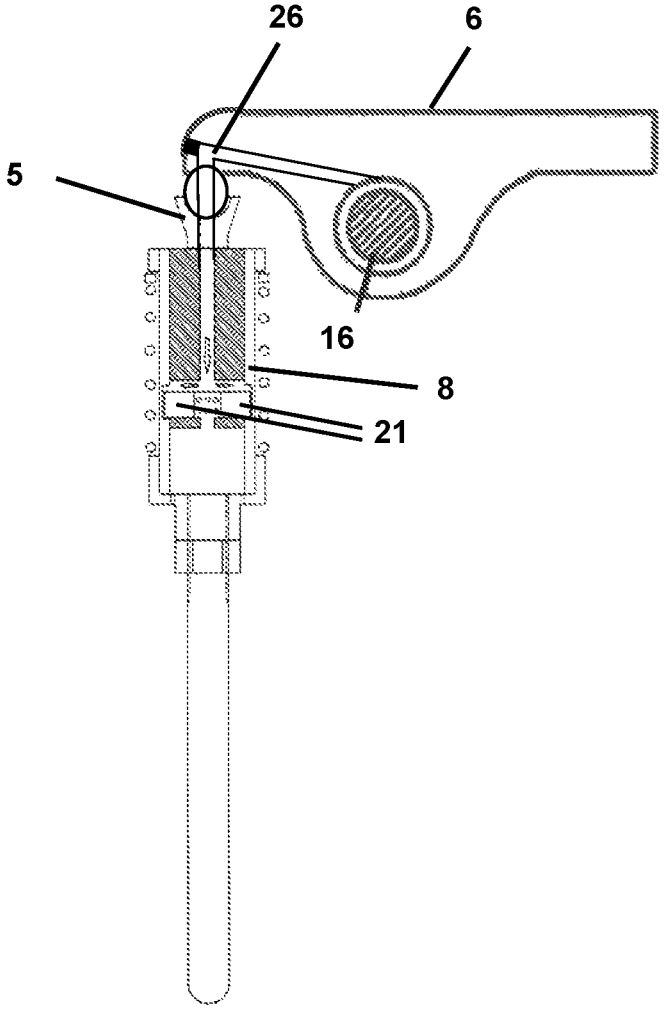
FIG. 8 shows an alternate embodiment for the collapsible pushrod valve actuation system in which the oil pressure control signal comes through the rocker.

FIG. 8 shows an alternate design for the CPS in which the oil pressure control signal comes from the rocker 6 by means of passage 26, through plunger 5 where it activates pins 21. The collapsible pushrod device 8 can be configured for either partial or total collapse.

Figure 9:
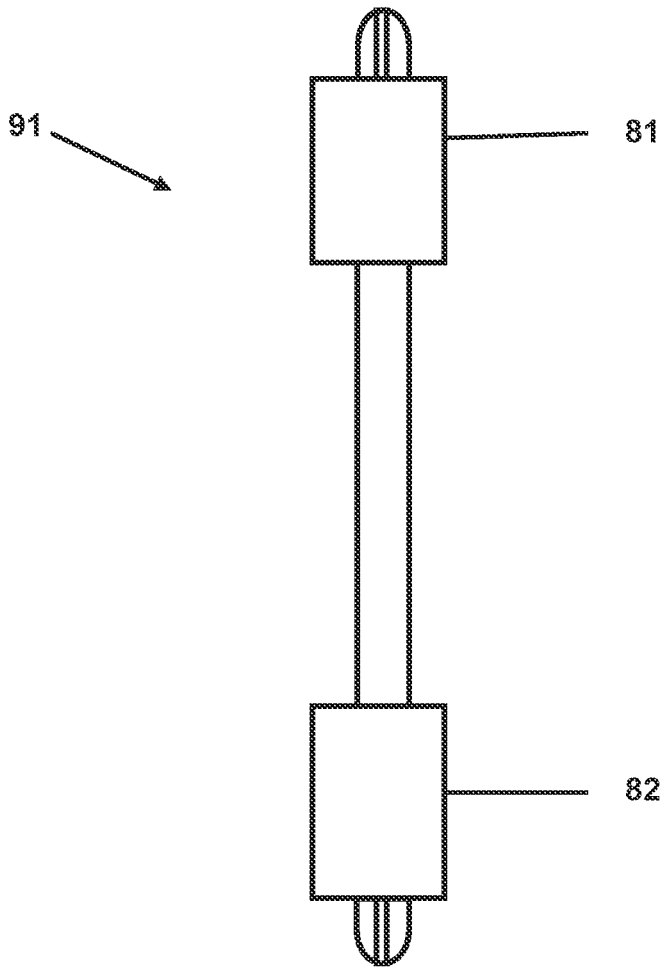
FIG. 9 shows an alternate embodiment for a combined collapsible pushrod valve actuation system which contains multiple collapser units.

FIG. 9 shows an alternate design for a combined collapsible pushrod device 91 which contains two collapser units. One, for example the upper collapser unit 81, is fully collapsing with oil pressure activation through the rocker. The lower collapser unit 82 is partially collapsing with oil activation through the lifter. Depending on which collapser unit is activated, either partial or no valve motion occurs.

The two collapser units may be combined into a single assembly.

When several engine cylinders are equipped with the combined collapsible pushrod device, the cylinders with partial lift and those deactivated can be alternated, for example, to equalize wear. In an engine application where all cylinders are equipped with the CPS, all cylinders can be set for partial valve lift to assist starting with a higher effective compression ratio. During warmed-up running some cylinders can be deactivated to provide part load benefits while the others operate at the lowered, design compression ratio.

A collapsible pushrod device may contain more than two collapser units to provide multiple amounts of collapse including total collapse.

Figure 10:
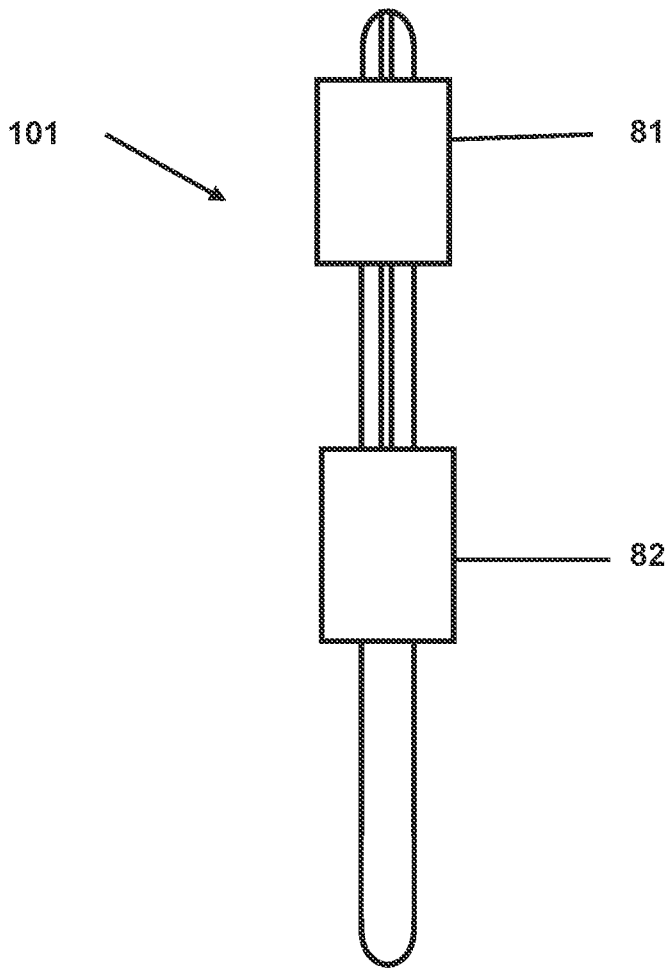
FIG. 10 shows an alternate embodiment for a combined collapsible pushrod valve actuation system in which two levels of oil pressure are used to activate the collapsible pushrod device to achieve two levels of collapsing.

FIG. 10 shows a collapsible pushrod device 101 with two collapser units activated by oil pressure. A lower pressure activates collapser unit 81 whereas a higher pressure additionally activates collapser unit 82, thus providing two levels of collapse altogether. Additional degrees of collapse may be provided by additional collapser units which are activated by additional levels of oil pressure.

With the embodiment providing total valve disablement and cylinder deactivation, fuel economy may be improved 20% or more under light and moderate load such as idling or surveillance operation.

For the purposes of this disclosure, an engine which utilizes the Miller Cycle is an internal-combustion engine as defined in U.S. Pat. No. 2,400,247. U.S. Pat. No. 2,400,247 is herein incorporated by reference in its entirety.

For the purposes of this disclosure, a pushrod is a mechanical linkage between a camshaft and a poppet valve or a lifter and a rocker. Many pushrods have oil passages through their length as part of a pressurized lubrication system.

All patents and publications mentioned in the prior art are indicative of the levels of those skilled in the art to which the invention pertains. All patents and publications are herein incorporated by reference to the same extent as if each individual publication was specifically and individually indicated to be incorporated by reference, to the extent that they do not conflict with this disclosure.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations, and broad equivalent arrangements.

We claim:

1. A collapsible pushrod actuation system configured to alter a lift of a poppet valve in a reciprocating piston machine cylinder, the system comprising:

a lifter configured to be actuated by a cam lobe; and a collapsible pushrod device functionally attached to the lifter and configured to remain rigid, partially collapse, or fully collapse, wherein the collapsible pushrod device comprises a deactivation assembly that contains lock pins within a housing.

2. The system of claim 1, further comprising a rocker arm functionally attached to the collapsible pushrod device and functionally attached to the poppet valve.

3. The system of claim 2, wherein an oil control signal emanates from the rocker.

4. The system of claim 1, wherein an oil control signal emanates from the lifter.

5. The system of claim 1, wherein the collapsible pushrod device comprises multiple collapser units.

6. The system of claim 5, wherein multiple levels of oil control pressure are used to activate the multiple collapser units.

7. The system of claim 1, further comprising a rocker arm functionally attached to the collapsible pushrod device and functionally attached to the poppet valve, wherein the collapsible pushrod device comprises multiple collapser units, further wherein an oil control signal emanates from both the rocker arm and the lifter.

8. The system of claim 1, wherein the collapsible pushrod device further comprises a thermal expansion mechanism to control the lock pins.

9. The system of claim 1, wherein the collapsible pushrod device further comprises a bi-metal spring to control the lock pins.

10. The system of claim 1, wherein the collapsible pushrod device further comprises an electromagnetic mechanism to control the lock pins.

11. The system of claim 2, further comprising a damper that is functionally attached to the rocker arm and configured to slow a rate at which the poppet valve closes.

* * * * *